US006135310A

United States Patent [19]

Svehaug

[11] Patent Number: 6,135,310

[45] Date of Patent: Oct. 24, 2000

[54] COMBINATION PAINT BRUSH HOLDER AND PAINT POURER UNIT FOR PAINT CANS

[76] Inventor: Oswald Svehaug, 275 Shirley St., Chula Vista, Calif. 91910

[21] Appl. No.: 09/428,553

[22] Filed: Oct. 28, 1999

[51] Int. Cl.[7] ..... B65D 25/40

[52] U.S. Cl. ..... 220/700; 220/699; 220/697; 220/736; 220/756; 222/570

[58] Field of Search ..... 220/700, 699, 220/697, 701, 702, 735, 736, 756; 222/570

[56] References Cited

U.S. PATENT DOCUMENTS

| | | | |
|---|---|---|---|
| 2,151,895 | 3/1939 | Carlson | 220/697 |
| 2,601,190 | 6/1952 | Wells | 220/700 |
| 2,630,241 | 3/1953 | Schnabel | 220/700 |
| 2,837,256 | 6/1958 | Daner | 220/700 |
| 4,101,046 | 7/1978 | Puntillo | 220/697 |
| 4,203,537 | 5/1980 | McAlister | 220/697 |
| 4,266,746 | 5/1981 | Klaiber | 220/699 |
| 4,919,298 | 4/1990 | Gregory | 220/756 |
| 5,092,481 | 3/1992 | Skelton | 220/756 |
| 5,234,133 | 8/1993 | Kensey | 220/700 |
| 5,913,450 | 6/1999 | Runkel | 220/700 |

*Primary Examiner*—Joseph M. Moy
*Attorney, Agent, or Firm*—Charles C. Logan II

[57] ABSTRACT

A combination paint brush holder and paint pourer unit for paint cans. It has a horizontally oriented annular neck portion designed to removably snap fit into the top end opening of a paint can. Connected to the top edge of the annular neck portion is a horizontally oriented upper wall portion having a pouring spout formed at its front end. It's left and right sides each have a vertical recess in their outer surface for capturing a wire bail handle of a paint can when it raised to a vertical position. A paint brush wiper portion is connected to the top edge of the annular neck portion adjacent the rear end of the upper wall portion. An auxiliary handle is detachably secured to the metal wire bail handle of a paint can. The auxiliary handle has a strip of hook or loop fastening material secured to its front or rear surface that matably receives a strip of hook or loop material that would be attached to the handle of a paint brush. While the paint can handle is captured in its vertical position, the paint brush can be detachably secured to the auxiliary handle at various heights depending upon how much of the paint brush bristles a user wishes to dip into the paint within the can.

16 Claims, 9 Drawing Sheets

COMBINATION PAINT BRUSH HOLDER AND PAINT POURER UNIT FOR PAINT CANS

BACKGROUND OF THE INVENTION

The invention relates to paint cans and more specifically to a combination paint brush holder and paint pourer unit that would be detachably secured to the top end of a paint can and its wire bail handle.

One of the major problems of working out of a paint can involves having the mess of paint drip and run down the side of the can. As the painter wipes the excess paint off the brush on the inner edge of can the paint has a tendency to drip downwardly over the outer surface of the can. A second major problem when painting from a can is where to place the paint brush when taking a break. Some of these problems have been addressed in prior art patents.

The Hoffman et al U.S. Pat. No. 2,466,850 is directed to a combined paint brush holder and wiper. It is adapted to fit over the upper end of a paint can and it is formed of a single piece of wire or other material. The handle of the brush is releasably captured between resilient portions of the wire.

The Kirsch U.S. Pat. No. 2,562,496 is directed to a double container connector. It has for one of its objects the production of a simple and efficient means for supporting a paint brush within a container and also sealing the container by means of another inverted container so as to preserve a paint brush in usable condition for future use.

The Kirshenbaum U.S. Pat. No. 3,016,169 is directed to a paint can attachment. The paint brush can be held in a suspended state either inside the paint can or external to the paint can. The structure for holding the paint brush is a magnet.

The Harley U.S. Pat. No. 4,116,332 discloses a combination paint brush holder and can connector. It has a flange that provides a suitable surface for removing excess paint from the brush. The brush holder is made of spring steel wire and can be squeezed together to allow the paint brush to be removed or its height adjusted in the bucket of paint. A second can may also be attached to the top of the can connector structure to prevent additional air from drying out the paint.

The Buck U.S. Pat. No. 4,583,666 discloses an attachment for use on paint cans. It has a brush holding device fixed to the rim guard. Recesses removably receive the handle of the paint can and maintain it in a substantially upright manner.

The Kovathana U.S. Pat. No. 5,568,879 is directed to a versatile and universal paint can attachment. It has a pouring spout extending outwardly from the outside walls. It has an elastic band that is used to hold a paint brush in place.

It is an object of the invention to provide a novel combination paint brush holder and paint pourer unit for paint cans that can be easily attached and detached from the top end of a paint can.

It is another object of the invention to provide a novel combination paint brush holder and paint pourer unit for paint cans that incorporates structure for detachably securing the wire handle of a paint can in a substantially vertical position.

It is a further object of the invention to provide a novel combination paint brush holder and paint pourer unit for paint cans that has both a pouring spout and a paint brush wiper portion.

It is also an object of the invention to provide a novel combination paint brush holder and paint pourer unit for paint cans that has an auxiliary handle that is detachably secured to the wire bail handle of the paint can and having structure for detachably securing the handle of a paint brush thereto.

It is an additional object of the invention to provide a novel combination paint brush holder and paint pourer unit for paint cans that is economical to manufacture and market.

SUMMARY OF THE INVENTION

The combination paint brush holder and paint pourer unit for paint cans has a horizontally oriented annular neck portion that is designed to removably fit into the top end of a standard gallon paint can. The bottom edge of the annular neck portion has one or more vertical recesses in its bottom edge that allows the annular neck portion to be compressed slightly during insertion and also allows the protruding annular rib on the outer surface of the neck portion to pass through the opening in the top of the paint can. When this compression is released, the annular neck portion expands to its normal diameter and the annular rib functions to lock the annular neck portion in the top end of the paint can.

Connected to the top end of the annular neck portion is an upper wall portion having a pouring spout at its front end. It's left and right sides have vertically extending inwardly extending recesses that function to capture the wire handle of a paint can in a substantially vertical position. Both forwardly and rearwardly of each of these side wall recesses, the respective side walls have a diameter greater than that between the two recesses themselves. The upper wall portion is made of resilient material which allows the wire handle of the paint can to compress them inwardly until the wire bail handle snaps into the respective vertical recesses. A paint brush wiper portion is also connected to the top edge of the annular neck portion adjacent its rear end. This structure allows the paint brushes to be wiped across it's front edge to remove the excess paint and the excess paint then drips back into the paint can.

An auxiliary handle is detachably secured to the wire bail handle of the paint can. It has a groove in its top surface for removably receiving the wire bail handle. Either the front or rear wall of the auxiliary handle would have a strip of hook and loop fastening material secured thereto. A similar strip of hook and loop fastening material would be secured to the handle of the paint brush so that when the two of them are placed in contact together, the paint brush would be held at a predetermined height with its bristles in the paint. Temporary positioning of a paint brush with its bristles in the paint is known as pickling.

The novel combination paint brush holder and paint pourer unit fits any standard gallon paint can. It is preferably integrally formed of plastic material. It is easy to clean and while in use it is easy to stir the paint.

The auxiliary handle has a substantially straight longitudinal bottom surface. It has a transverse radial contour greater than that of the wire bail handle of the paint can. This distributes the weight on the fingers over a greater area and reduces the concentrated weight across the fingers of the person carrying the paint can. The auxiliary handle keeps the paint brushes soft and pliable. It also saves the life of the brush and saves time. The auxiliary handle is also preferably made of light weight plastic material.

DESCRIPTION OF THE PREFERRED EMBODIMENT

Figure 1:
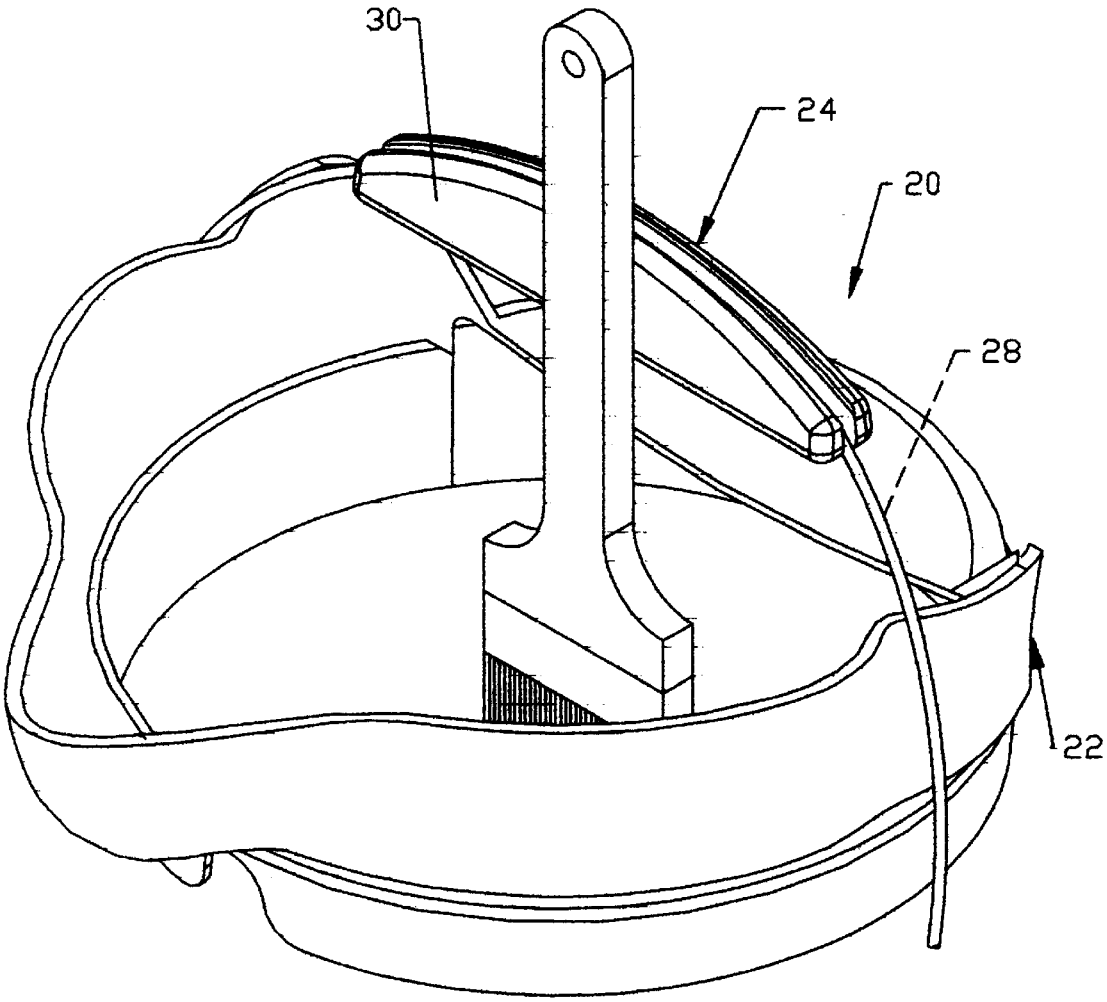
FIG. 1 is a front perspective view of the combination paint brush holder and paint pourer unit for paint cans.
Figure 2:
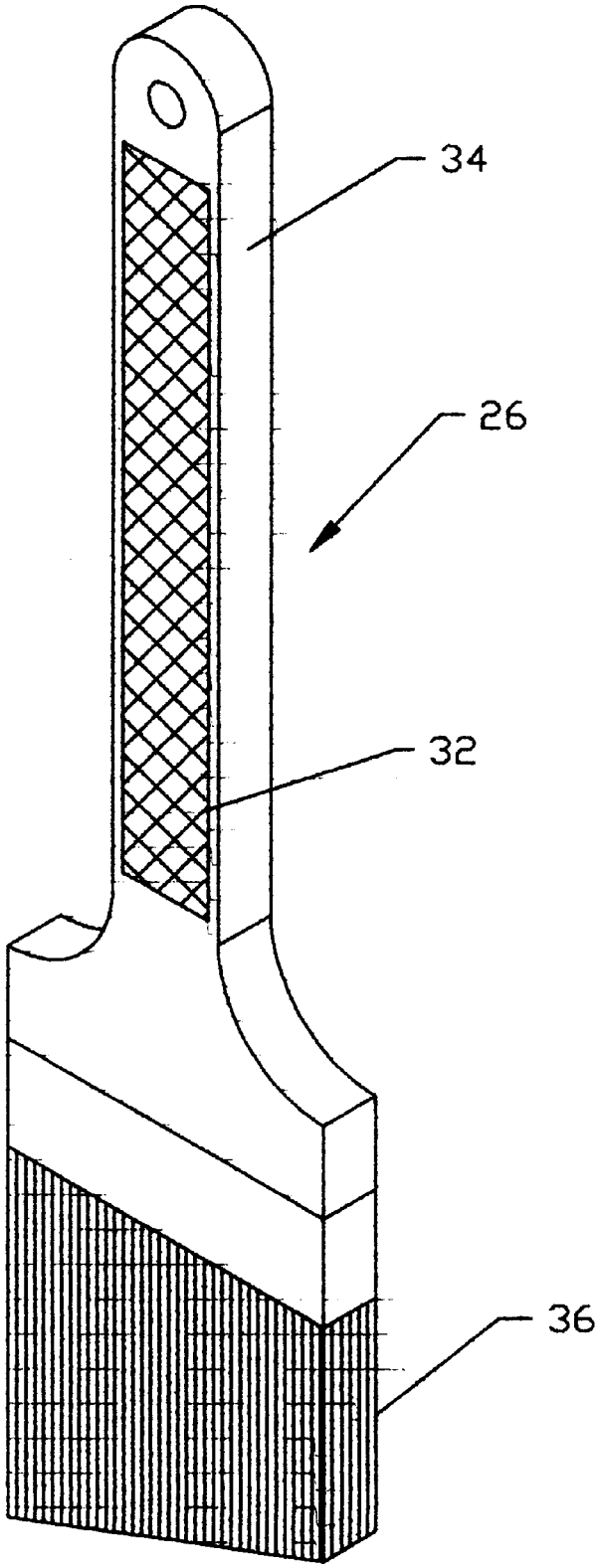
FIG. 2 is a front perspective view of a paint brush having a strip of hook and loop fastening material on its handle.
Figure 3:
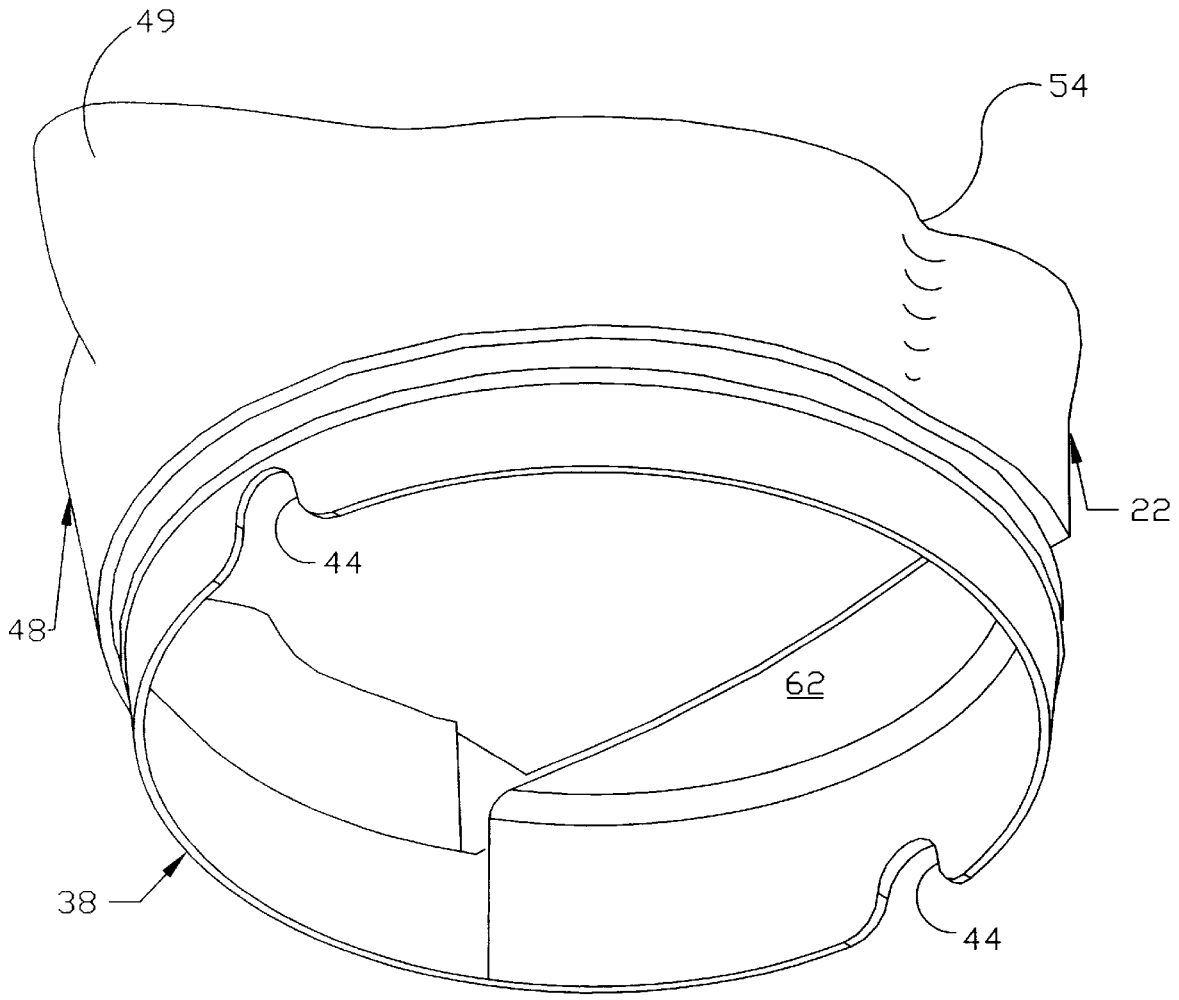
FIG. 3 is a bottom perspective view of the combination paint brush holder and paint pourer unit.
Figure 4:
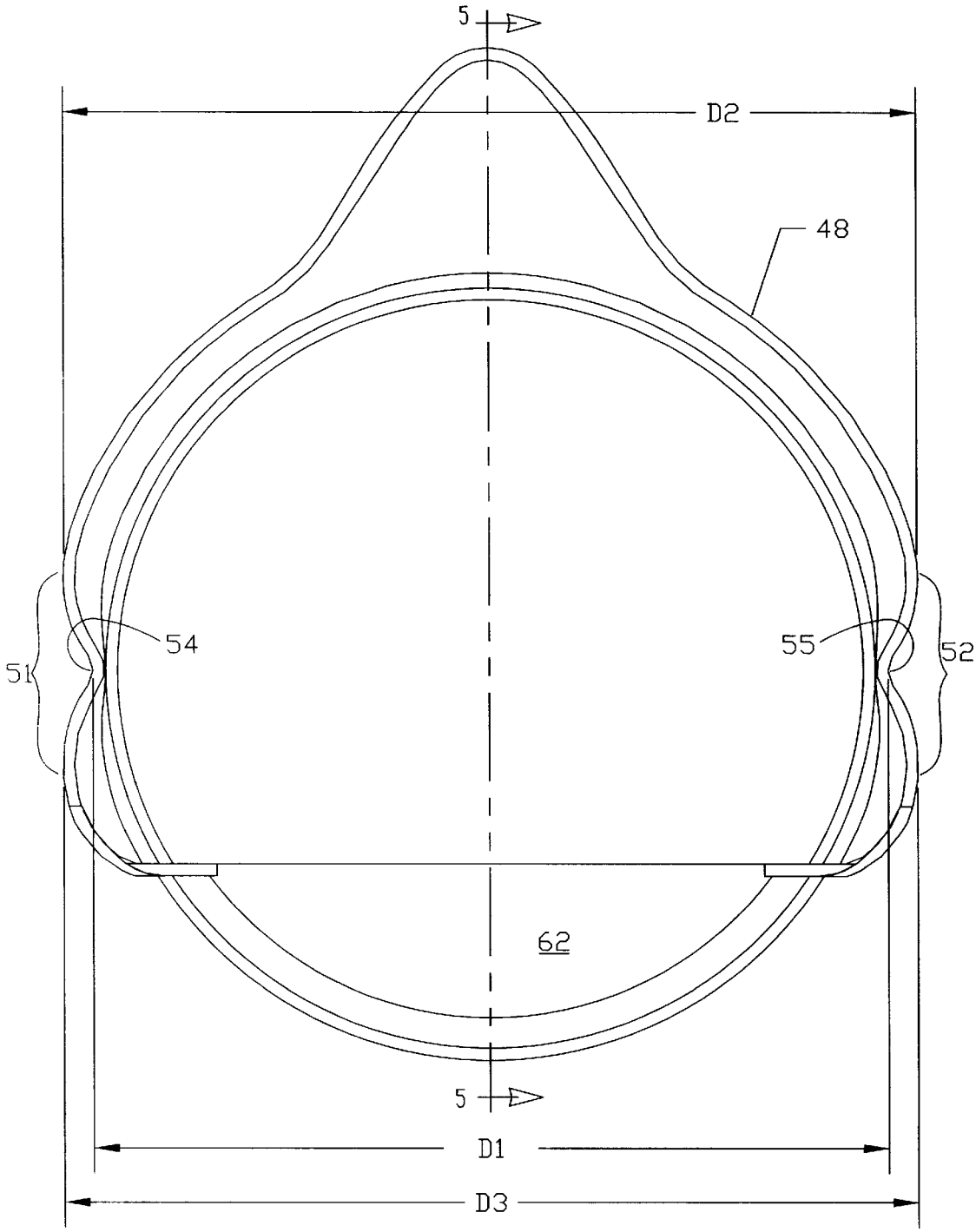
FIG. 4 is a top plan view of the combination paint brush holder and paint pourer unit.
Figure 5:
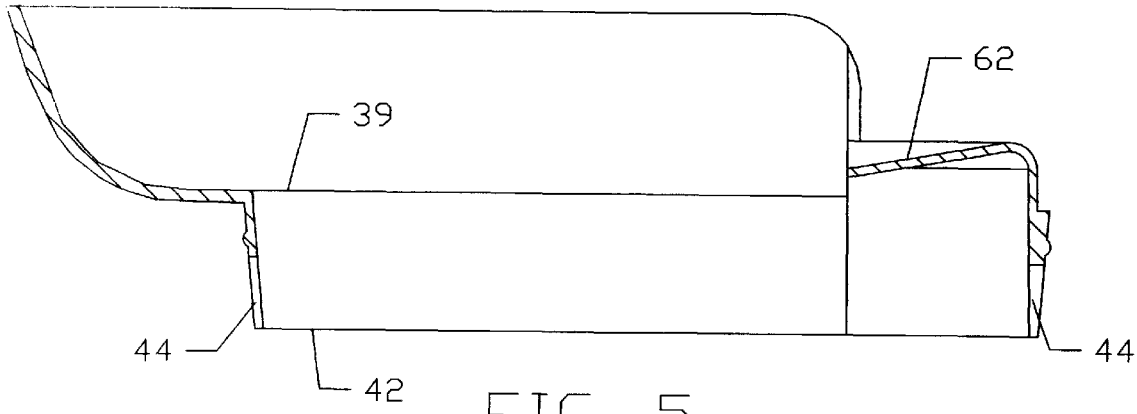
FIG. 5 is a cross sectional view taken along lines 5—5 of FIG. 4.
Figure 6:
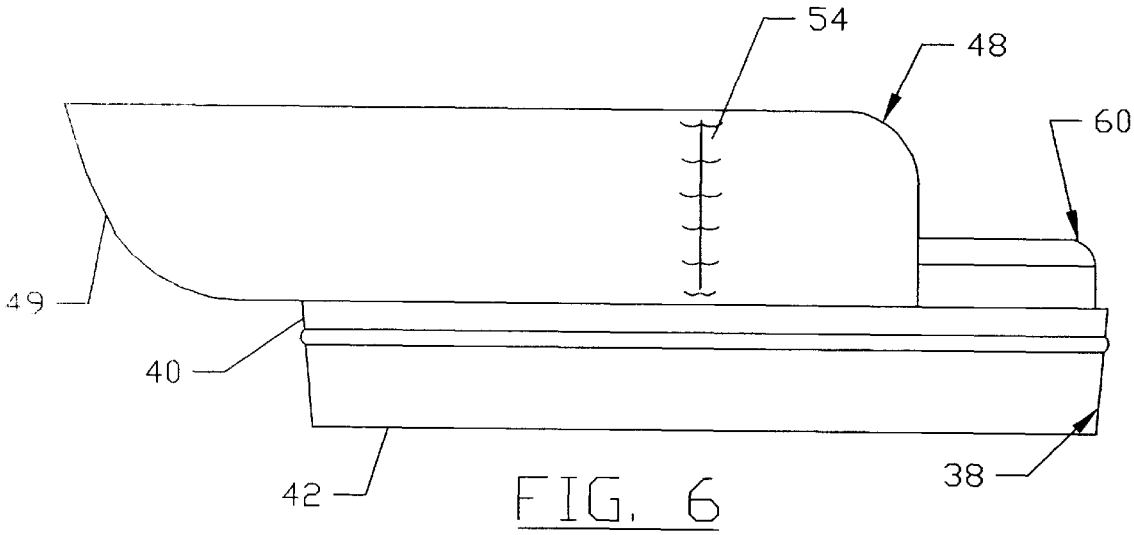
FIG. 6 is a left side elevation view of the combination paint brush holder and paint pourer unit.
Figure 7:
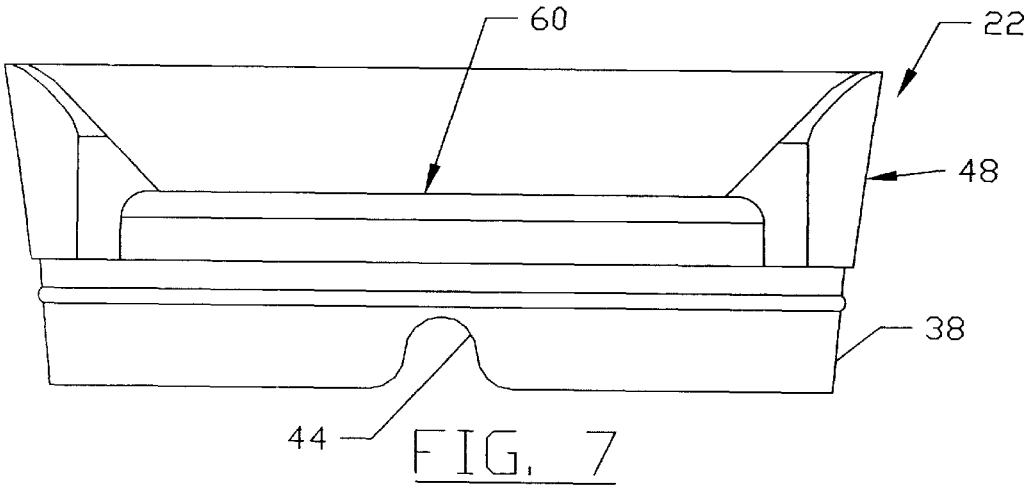
FIG. 7 is a rear elevation view of the combination paint brush holder and paint pourer unit.
Figure 8:
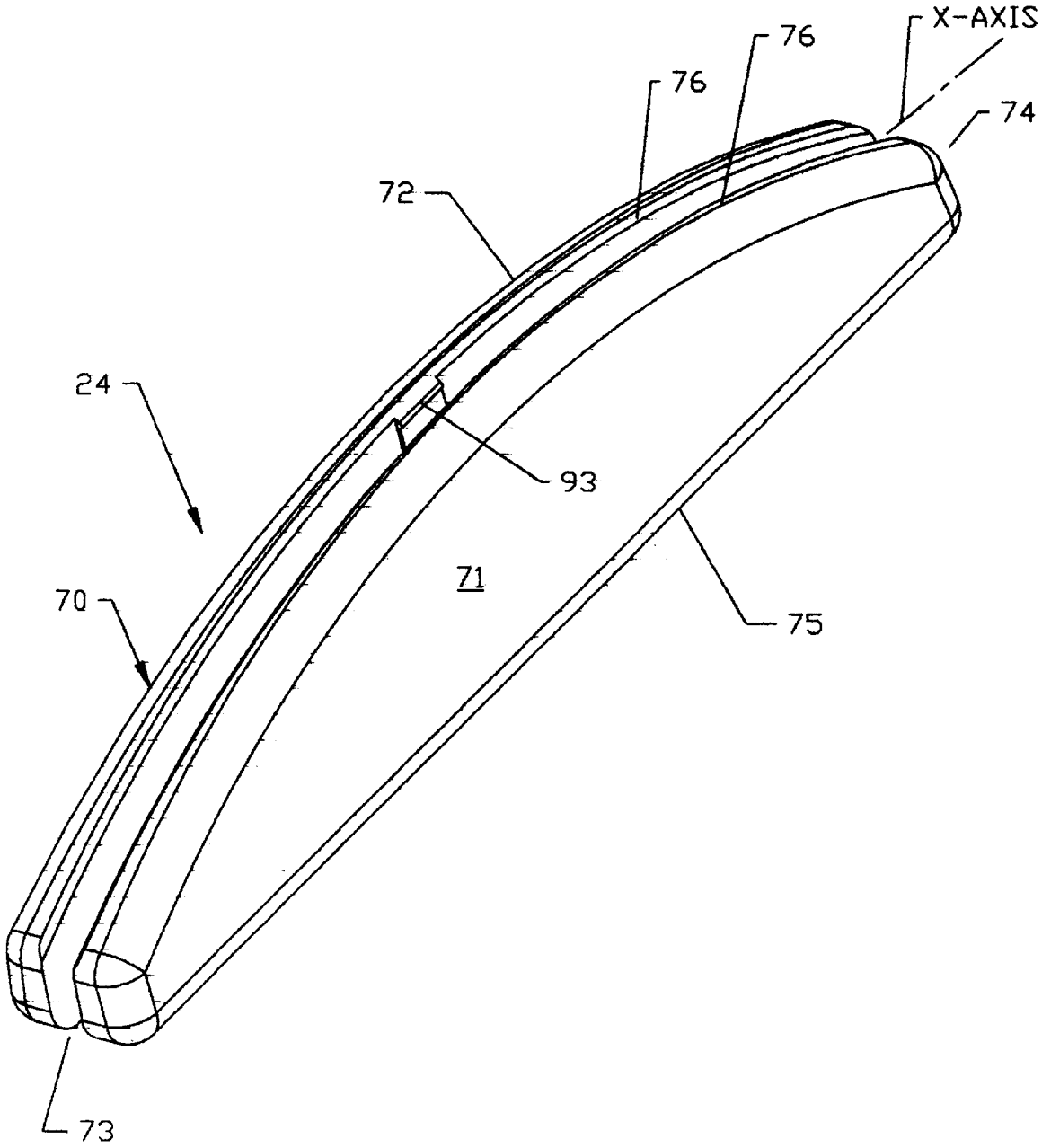
FIG. 8 is a front perspective view of the novel detachable auxiliary handle.
Figure 9:
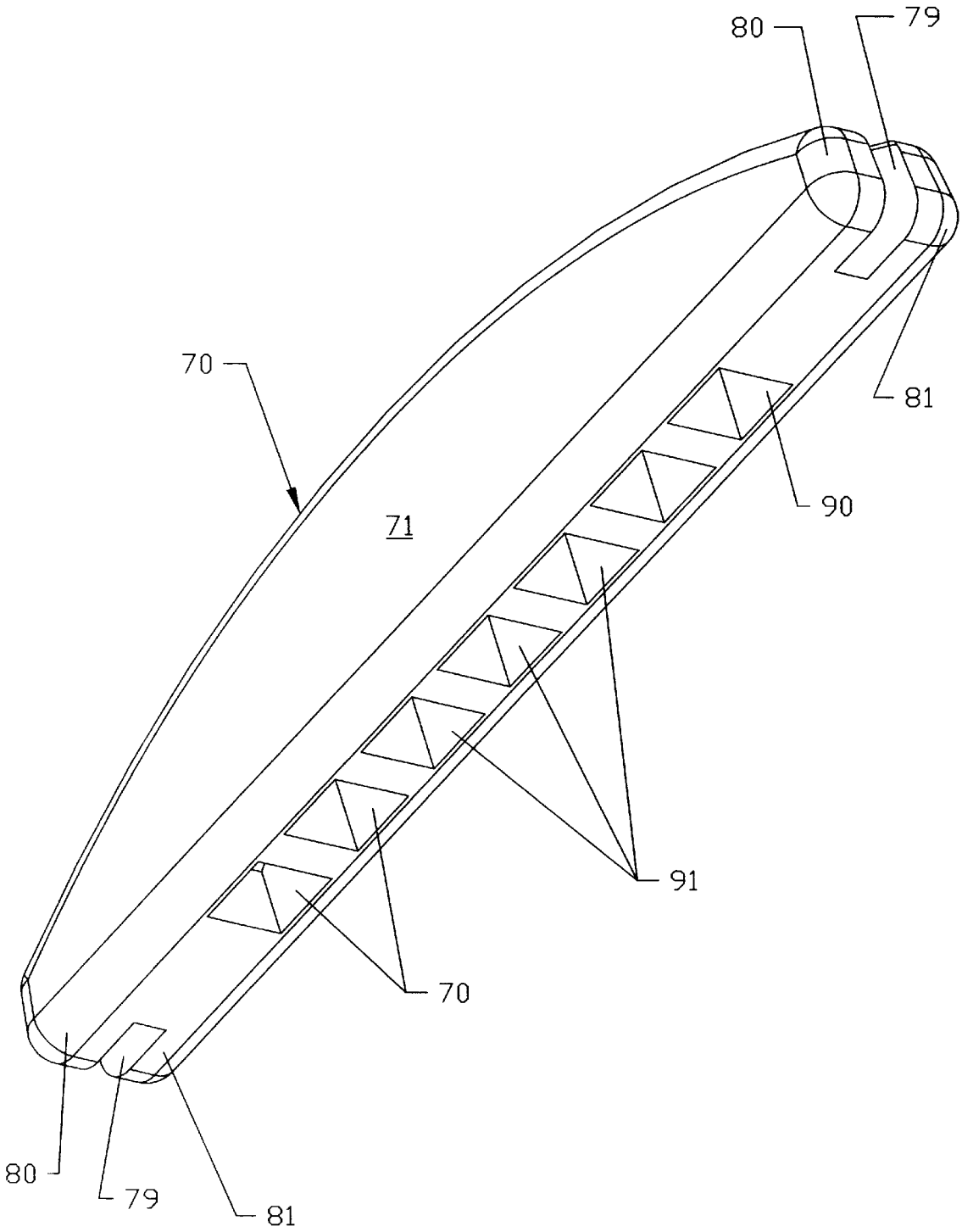
FIG. 9 is a bottom perspective view of the detachable auxiliary handle.
Figure 10:
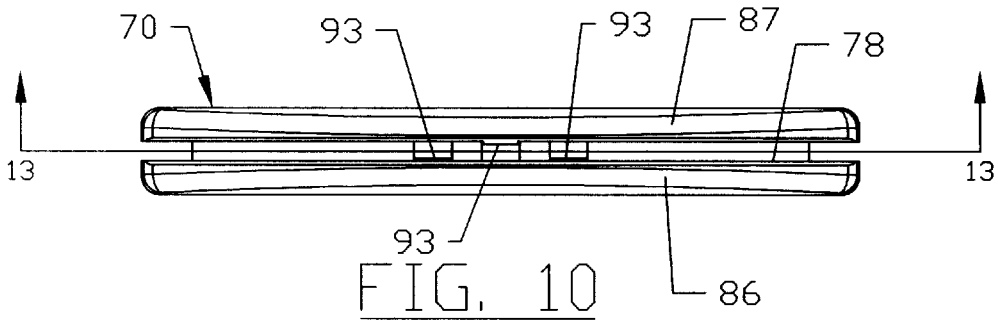
FIG. 10 is a top plan view of the detachable auxiliary handle.
Figure 11:
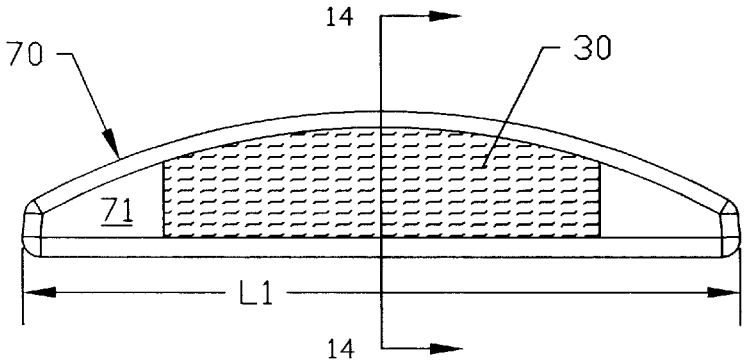
FIG. 11 is a front elevation view of the detachable auxiliary handle.
Figure 12:
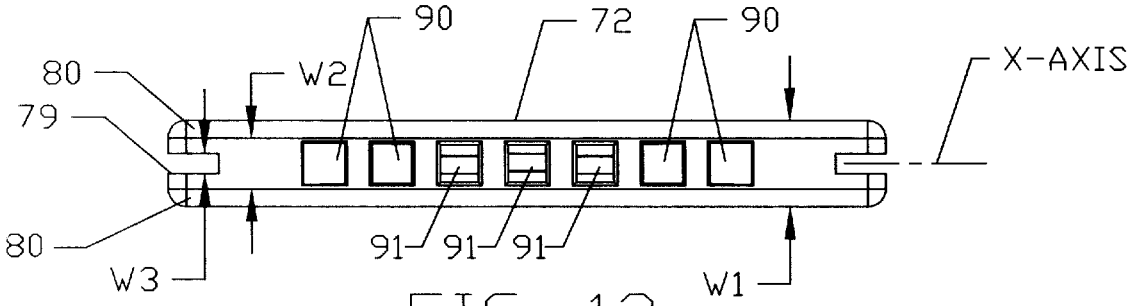
FIG. 12 is a bottom plan view of the detachable auxiliary handle.
Figure 13:
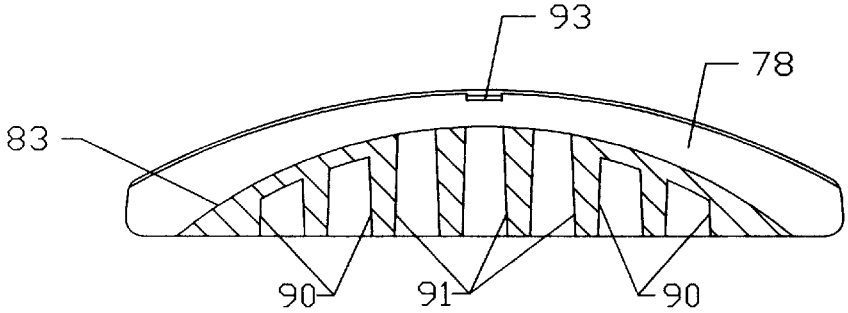
FIG. 13 is a cross sectional view taken along lines 13—13 of FIG. 10.
Figure 16:
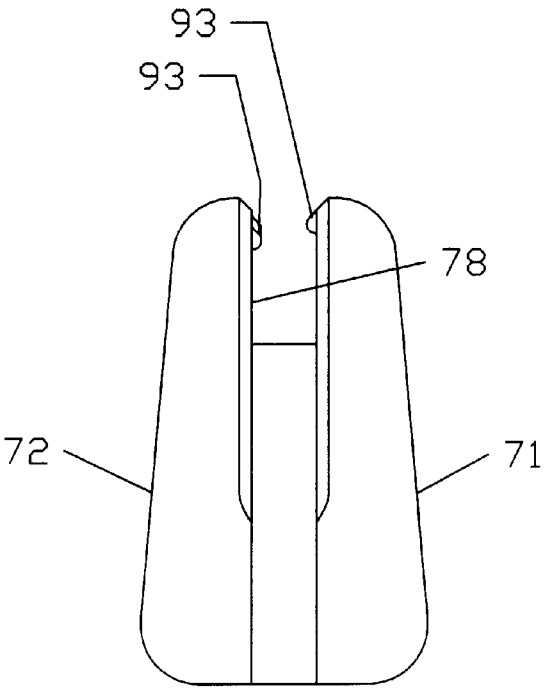
FIG. 16 is a left end elevation view of the detachable auxiliary handle.
Figure 14:
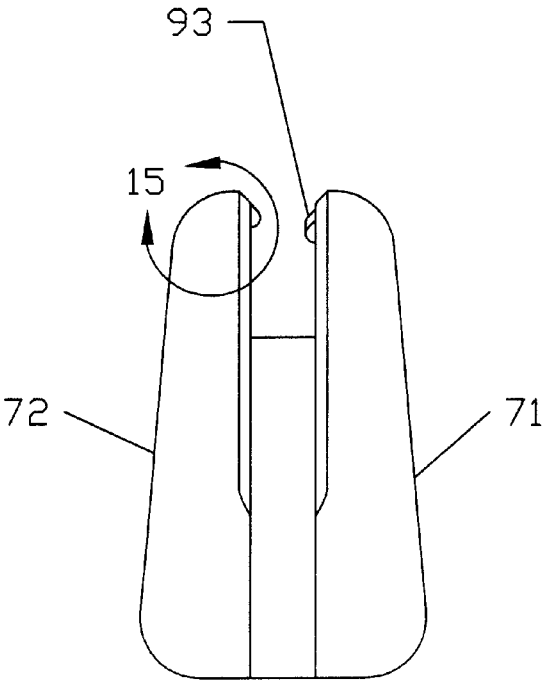
FIG. 14 is an enlarged cross sectional view taken along lines 14—14 of FIG. 11.
Figure 15:
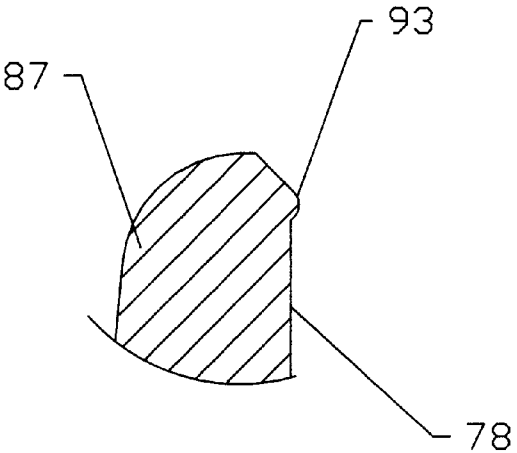
FIG. 15 is an enlarged view of the circular portion 15—15 of FIG. 14.

The novel combination paint brush holder and paint pourer unit for paint cans will now be described by referring to FIGS. 1–16 of the drawings. FIG. 1, the combination paint brush holder and paint pourer unit is generally designated numeral 20. The paint pourer unit 22 and detachable auxiliary handle 24 illustrate how the paint brush 26 is supported on the wire bail handle 28 of a paint can. A strip of hook and loop material 30 is attached to the auxiliary handle 24. An opposing strip of hook and loop material 32 is secured to the handle 34 of paint brush 26 in the manner illustrated in FIG. 2. The bristles of paint brush 26 are designated numeral 36. Referring to FIGS. 3–7, the specific structure of paint pourer unit 22 will now be described. Paint pourer unit 22 has a horizontally oriented annular neck portion 38 having a top edge 39, a front end 40, a rear end 41, and a bottom edge 42. Vertical recesses 44 are formed in bottom edge 42 adjacent front end 40 and rear end 41.

A horizontally oriented upper wall portion 48 is connected to the top edge 39 of annular neck portion 38. Upper wall portion 48 has a pouring spout 49 formed at its front end. A left side paint can handle retainer portion 51 and a right side paint can handle retainer portion 52 are formed on the respective left and right sides of upper wall portion 48. A vertical groove or recess 54 and 55 is formed in each of the respective left and right side paint can handle retainer portions 51 and 52 and there is a diameter D1 between these opposing recesses. The distance between the opposing left and right side paint can handle retainer portions forwardly and rearwardly of the recesses 54 and 55 have respectively a diameter D2 and D3 and D2 and D3 are greater than D1. Grooves 54 and 55 provide a releasable locking structure for retaining the wire bail handle 28 of a paint can in a substantially vertical position.

Paint brush wiper portion 60 is connected to top edge 39 of annular neck portion 38 adjacent its rear end 41. The paint brush wiper portion 60 is also connected to the rear end of upper wall portion 48. In its preferred embodiment, the entire structure of the paint pourer unit would be an integrally formed plastic member. Paint wiper portion 60 has front wall 62 that slopes downwardly and forwardly.

Auxiliary handle 24 is best described by referring to FIGS. 8–16 of the drawings. Auxiliary handle 24 has an elongated body 70, a front wall 71, a rear wall 72, a left end 73, a right end 74, a bottom wall 75, a top edge 76, and a longitudinal X-axis. A channel 78 extends from left end 73 to right end 74 and forms a groove 79 in each of these ends having laterally spaced fingers 80 and 81. The bottom surface 83 of channel 78 has a convex curvature along the X-axis. Channel 78 forms upstanding front flange 86 and upstanding rear flange 87. Elongated body 70 has a width W1 in the range of ⅜–¾ inches. Channel 78 has a width W2 in the range of 0.100–0.300 inches. Grooves 79 have a width W3 in the range of 0.200–0.400 inches. Elongated body 70 has length L1 in the range of 3–6 inches.

A plurality of cavities 90 and bore holes 91 are formed in bottom wall 75. A plurality of lips or protrusions 93 extend inwardly on the inner surfaces of the respective front and rear flanges 86 and 87. These flanges are resilient enough to allow the wire bail handle 28 of a paint can to spread them apart when it is forced downwardly therebetween. Thereafter they would spring back together to capture wire bail handle 28. A strip of hook or loop fastening material 30 is secured on either the front wall 71 or rear wall 72 of auxiliary handle 24.

What is claimed is:

1. A combination paint brush holder and paint pourer unit for paint cans comprising:

a horizontally oriented annular neck portion having a top edge, a bottom edge, a front end, a rear end, a left side, a right side and an outer surface; said annular neck portion being designed to removably fit into a top end of a paint can;

a horizontally oriented upper wall portion having a top edge, a bottom edge, a front end, a rear end, a left side, and a right side; said bottom edges of said front end, said left side, and said right side being connected to said respective top edge of said front end, said left side and said right side of said annular neck portion; said front end of said upper wall portion having the configuration of a pouring spout; and means on said left and right sides of said upper wall portion for detachably retaining a wire bail handle of a paint can in a substantially vertical orientation.

2. A combination paint brush holder and paint pourer unit for paint cans as recited in claim 1 wherein said means for detachably retaining a wire bail handle of a paint can in a substantially vertical orientation comprises a vertical recess in the outer surface in each of said left and right sides of said upper wall portion for removably capturing a wire bail handle of a paint can when raised to a vertical position.

3. A combination paint brush holder and paint pourer unit for paint cans as recited in claim 1 further comprising a paint brush wiper portion connected to said top edge of said annular neck portion adjacent said rear end of said upper wall portion.

4. A combination paint brush holder and paint pourer unit for paint cans as recited in claim 3 wherein said paint brush wiper portion has a front wall that slopes forwardly and downwardly to allow paint wiped off of a brush to drop into a paint can.

5. A combination paint brush holder and paint pourer unit for paint cans as recited in claim 1 further comprising a protruding annular rim on said outer surface of said annular neck portion for detachably securing said combination paint brush paint holder and pourer unit into a top end of a paint bucket.

6. A combination paint brush holder and paint pourer unit for paint cans as recited in claim 1 wherein said bottom edge of said annular neck portion has at least one vertically oriented recess that allows said annular neck portion to be compressed during insertion into a top end of a paint can.

7. A combination paint brush holder and paint pourer unit for paint cans as recited in claim 1 further comprising an auxiliary handle to be detachably secured to a wire bail handle of a can.

8. A combination paint brush holder and paint pourer unit for paint cans as recited in claim 7 wherein said detachable auxiliary handle comprises:

an elongated body having a top end, a bottom end, a front wall having an outer surface, a rear wall having an outer surface, a left end, and a right end; said elongated body having a longitudinally extending x-axis from said left end to said right end; said top end having a longitudinal channel extending substantially from said left end to said right end; said channel having a bottom surface having a substantially convex curvature from said left end of said channel to said right end of said channel, said channel defining an upstanding front flange having an inner surface and an upstanding rear flange having an inner surface;

said elongated body having a length L1 in the range of 3–6 inches, a width W1 in the range of ⅛–⅝ inches and said channel having a width W2 in the range of 0.100–0.300 inches; and means for detachably securing a handle of a paint brush to said outer surface of one of said front wall or said rear wall.

9. A detachable auxiliary handle for a paint can as recited in claim 8 wherein said handle is made of plastic material.

10. A detachable auxiliary handle for a paint can as recited in claim 8 wherein said elongated body has a groove formed in said left and right ends that substantially align with said x-axis.

11. A detachable auxiliary handle for a paint can as recited in claim 8 further comprising a plurality of cavities in said bottom end of said elongated body.

12. A detachable auxiliary handle for a paint can as recited in claim 8 wherein said bottom end of said elongated body has a substantially straight surface along said x-axis.

13. A detachable auxiliary handle for a paint can as recited in claim 8 wherein said front and rear flanges have a top edge having a substantially convex surface along said x-axis.

14. A detachable auxiliary handle for a paint can as recited in claim 8 further comprising means for detachably capturing a wire bail handle of a paint can in said channel formed in said top end of said elongated body.

15. A detachable auxiliary handle for a paint can as recited in claim 8 wherein said means for detachably securing a handle of a paint brush to said outer surface of one of said front wall or rear wall comprises a strip of hook and loop fastening material secured to said outer surface.

16. A detachable auxiliary handle for a paint can comprising:

an elongated body having a top end, a bottom end, a front wall having an outer surface, a rear wall having an outer surface, a left end, and a right end; said elongated body having a longitudinally extending x-axis from said left end to said right end; said top end having a longitudinal channel extending substantially from said left end to said right end; said channel having a bottom surface having a substantially convex curvature from said left end of said channel to said right end of said channel, said channel defining an upstanding front flange having an inner surface and an upstanding rear flange having an inner surface;

said elongated body having a length L1 in the range of 3–6 inches, a width W1 in the range of ⅛–⅝ inches and said channel having a width W2 in the range of 0.100–0.300 inches; and means for detachably securing a handle of a paint brush to said outer surface of one of said front wall or said rear wall.

* * * * *